United States Patent [19]

Colvin

[11] Patent Number: 4,977,800

[45] Date of Patent: Dec. 18, 1990

[54] SCREWDRIVER BLADE CONSTRUCTION

[76] Inventor: David S. Colvin, 23933 Haynes, Farmington Hills, Mich. 48024

[21] Appl. No.: 497,801

[22] Filed: Mar. 21, 1990

Related U.S. Application Data

[63] Continuation of Ser. No. 292,481, Dec. 30, 1988, abandoned.

[51] Int. Cl.[5] ..... B25B 15/00

[52] U.S. Cl. ..... 81/436

[58] Field of Search ..... 81/436; D8/82, 86

[56] References Cited

U.S. PATENT DOCUMENTS

| | | |
|---|---|---|
| 67,014 | 7/1867 | Ayres . |
| 260,795 | 7/1882 | Smith . |
| 417,722 | 12/1889 | Hart . |
| 432,928 | 7/1890 | Bartlett . |
| 1,056,095 | 3/1913 | Groos . |
| 1,361,790 | 12/1920 | Brown . |
| 1,479,506 | 1/1924 | Kellemen . |
| 2,684,094 | 7/1954 | Lissy . |
| 2,782,823 | 2/1957 | De Alt, Jr. . |
| 2,792,039 | 5/1957 | Wing et al. . |
| 2,994,354 | 8/1961 | Vaughn . |
| 3,026,920 | 3/1962 | York . |
| 3,120,251 | 2/1964 | York . |
| 3,897,812 | 8/1975 | Arnn . |
| 3,923,088 | 12/1975 | Arnn . |
| 4,311,071 | 1/1982 | Bassell . |
| 4,452,289 | 6/1984 | Smith . |
| 4,625,598 | 12/1986 | Welfram ..... 81/436 |

*Primary Examiner*—D. S. Meislin

*Attorney, Agent, or Firm*—Brooks & Kushman

[57] ABSTRACT

A screwdriver (10) is disclosed as having a drive end (12), a shank (14), and a blade (16) rotatable about a central axis A and having a tip construction that facilitates driving without reducing strength. The screwdriver blade (16) has a length L and includes oppositely facing blade surfaces (18) and a tip (20) that cooperatively define a pair of spaced terminal edges providing a width dimension W, and the blade length L is in the range of about 3 to 9 W. Each blade surface (18) also has an engagement location (24) spaced from the adjacent terminal edge (22) by a depth dimension D that is in the range of about 0.2 to 0.5 W. Each engagement location (24) and the adjacent terminal edge (22) define an angle B with the central axis A in the range of about 0.5° to 3.3°. The screwdriver drive end (12) is disclosed as being embodied a manually grasped handle (29) and is disclosed as having best results with the depth dimension D about $\frac{1}{3}$ of the width dimension W, with each angle B about 2°, with the terminal edges 24 spaced from each other by a thickness dimension T and with the depth dimension being in the range of about 0.3 to 2.5 T and most preferably about 1.2 T; and with the length L about 6 W.

14 Claims, 2 Drawing Sheets

SCREWDRIVER BLADE CONSTRUCTION

This is a continuation of copending application Ser. No. 07/292,481, filed on Dec. 30, 1988, now abandoned.

TECHNICAL FIELD

This invention relates to screwdrivers.

BACKGROUND ART

The blade geometry of a conventional screwdriver has oppositely facing planar blade surfaces that converge to a tip with an included angle of about 10°. This construction causes the screwdriver to cam out of the screw slot when rotational force is applied to screws resistant to turning. In an effort to minimize this tendency, the application of increased axial pressure in the direction of the screw is necessary as torque is being applied. In addition, the blade geometry creates point contact between the screwdriver and the screw slot and this together with the camming effect frequently causes deformation of the screw slot and an impediment to reuse of the screw.

Specially designed screwdrivers have previously incorporated oppositely facing parallel or diverging blade tip surfaces. Although these screwdrivers maintain screw head contact with less axial pressure applied than is necessary with the conventional blade construction, the tips of such screwdrivers have always been so thin and thus structurally weak as to be susceptible to breakage. This is a particular problem when such screwdrivers are used as prys or chisels, as often is done.

Specially designed screwdriver-screw head systems facilitate screwdriver-screw engagement with less axial pressure than conventional screwdrivers and screw heads. However, a system that requires a screw head to be shaped to accommodate a particular screwdriver is not readily acceptable by consumers and industry.

Prior art patent noted by the investigation conducted for the present invention are described below.

U.S. Pat. No. 67,014 to Ayres for Screwdriver discloses a screw driver having a dove-tailed edge on its tip to facilitate screw head engagement.

U.S. Pat. No. 260,795 to Smith for Screw discloses a screw having a projection in the center of the screw slot and a screwdriver having a notch in the tip to hold the screwdriver in the screw slot.

U.S. Pat. No. 417,722 to Hart for Screw Driver discloses a screw driver having sunk portions at the opposite sides of the blade which engage the screw slot.

U.S. Pat. No. 432,928 to Bartlett discloses a Wrench for Screw Drivers which is used to increase the torque that can be applied during use.

U.S. Pat. No. 1,056,095 to Groos for Screw Driver discloses a screw driver having two transverse grooves on each surface of the screw driver tip to engage corresponding portions of the undercut groove in the screw head.

U.S. Pat. No. 1,361,790 to Brown for Valve And Grinding Mechanism Therefor discloses a valve and a valve grinding tool. The Brown valve includes a groove therein that has a curved bottom and side walls that include toward each other from the bottom of the groove to the top of the valve. The Brown valve grinding tool includes an integral tongue shaped in conformity with and adapted to fit the groove in the valve.

U.S. Pat. No. 1,479,506 to Kelleman for Screw Driver discloses a screwdriver having concave, hollow ground, oppositely facing tip surfaces. Oppositely facing planar surfaces extend from the tip surfaces toward the handle with a tapering to the nominal thickness of the screwdriver shaft connected to the handle.

U.S. Pat. No. 2,684,094 to Lissy for Nonslip Screw Driver and Screwhead discloses a screw head having undercut walls and a screw driver having outwardly flared projections for increasing the grip with the screw.

U.S. Pat. No. 2,782,823 to Williams, Jr., discloses a Magnetic Screw Driver including a bit received by a holder that also receives a permanent magnet capable of magnetizing the bit.

U.S. Pat. No. 2,792,039 to Wing et al for Slotted Screw Head and Driver Therefor Having Non-Burring Engagement discloses a combination screw head and a driver for the screw head where the screwdriver has an arcuate edge and side walls comprising surfaces of revolution diverging from each other toward said edge to engage with undercut portions of the screw slot.

U.S. Pat. No. 2,994,354 to Vaughn for Improved Screw Driver discloses a screwdriver having an arcuate bottom and parallel or converging oppositely facing tip surfaces for use with screw head slots provided with undercut non-planar surfaces.

U.S. Pat. Nos. 3,026,920 and 3,120,251 to York are each entitled Screwdriver and disclose screwdrivers having convex arcuate tips and concave opposite bearing surfaces defined by generally planar surface portions.

U.S. Pat. Nos. 3,897,812 and 3,923,088 to Arnn for Screw Driver and Biting Screw Driver each disclose a screwdriver having a foot portion shaped as an isosceles trapezoid in cross section to increase the gripping force with a screw slot.

U.S. Pat. No. 4,311,071 to Bassell for Screw Driver and Screw Head System discloses in combination a screw head and screw driver having oppositely facing diverging tip faces for engagement with the undercut side walls of the screw slot.

U.S. Pat. No. 4,452,289 to Smith discloses a Combination Hand Grip and Bits Storage for a screwdriver.

DISCLOSURE OF INVENTION

An object of the present invention is to provide an improved screwdriver which minimizes the axial pressure required to maintain screwdriver screw head contact while maintaining the structural integrity of a conventional screwdriver tip.

In carrying out the above object, a screwdriver constructed in accordance with the present invention has a central axis A and a drive end for rotating the screwdriver about the central axis A. The screwdriver also includes a shank that extends from the drive end along the central axis A and further includes a blade projecting from the shank along the central axis A with a length L. This blade has oppositely facing blade surfaces and a tip that cooperatively define a pair of spaced terminal edges providing a width dimension W. The length L is in the range of about 3 to 9 W. Each blade surface has an engagement location spaced from the adjacent terminal edge by a depth dimension D that is in the range of about 0.2 to 0.5 W. The engagement location of each blade surface and the adjacent terminal edge define an angle B with the central axis A in the range of about 0.5 to 3.3°.

In the preferred construction, the screwdriver has its drive end embodied by a handle that is manually grasped to rotate the screwdriver about the central axis A.

In one embodiment, each blade surface has a continuously curved shape extending between the shank and the tip. The curved blade surfaces preferably each have a curvature with a radius in the range of about 20 to 120 W.

In two other embodiments of the screwdriver, the blade surfaces have planar tip surface portions that extend from the terminal edges for a greater distance than the depth dimension D at which the engagement locations are positioned. The blade surfaces of these embodiments also have connecting surface portions that extend from the tip surface portions to the shank. In one of these embodiments, the connecting surfaces portions have planar shapes extending between the tip surface portions and the shank, and the blade surfaces also preferably have curved surface portions that connect the planar tip surface portions and the planar connecting surface portions. In the other of these two embodiments, the connecting surface portions have curved shapes extending between the planar tip surface portions and the shank.

In each of the preferred embodiments, best results are achieved when: the depth dimension D is about $\frac{1}{3}$ of the width dimension W; each angle B is about 2 ; the terminal edges are spaced from each other by a dimension T with the depth dimension D in the range of about 0.3 to 2.5 D and most preferably about 1.2 T; and the length L is about 6 W.

Such a screwdriver allows the user to apply a minimal amount of axial pressure in order to maintain screwdriver contact with a screw head when torque is applied to the screw. This feature together with the creation of improved line contact between the screwdriver tip and the screw slot substantially reduces the possibility of deformation of the screw head. Also, when the screwdriver invention is used as a pry or chisel, as many screwdrivers are, the improved blade geometry gives the screwdriver the structural integrity of a conventional screwdriver and the possibility of tip breakage associated with specially designed screwdrivers is substantially reduced.

The above object and other objects, features, and advantages of the present invention are readily apparent from the following detailed description of the best modes for carrying out the invention when taken in connection with the accompanying drawings.

BEST MODES FOR CARRYING OUT THE INVENTION

Figure 1:
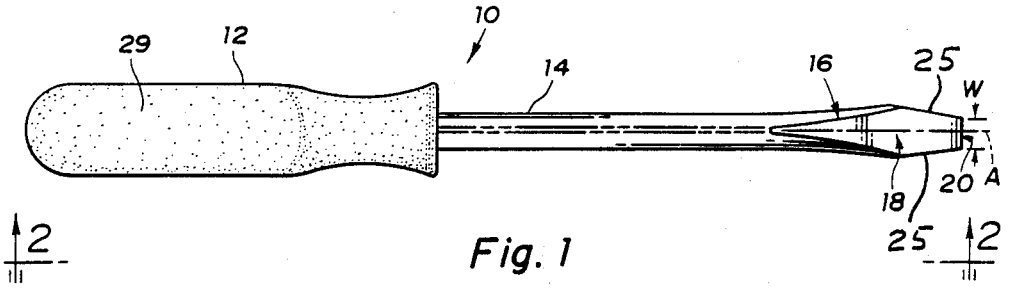
FIG. 1 is a side view of a screwdriver constructed according to the present invention.
Figure 2:
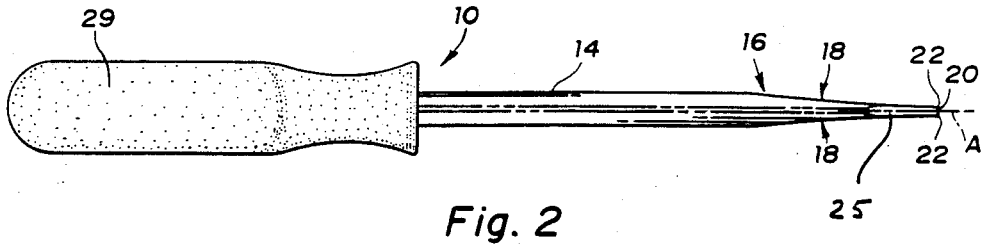
FIG. 2 is a side view of the screwdriver taken along the direction of line 2—2 in FIG. 1.
Figure 3:
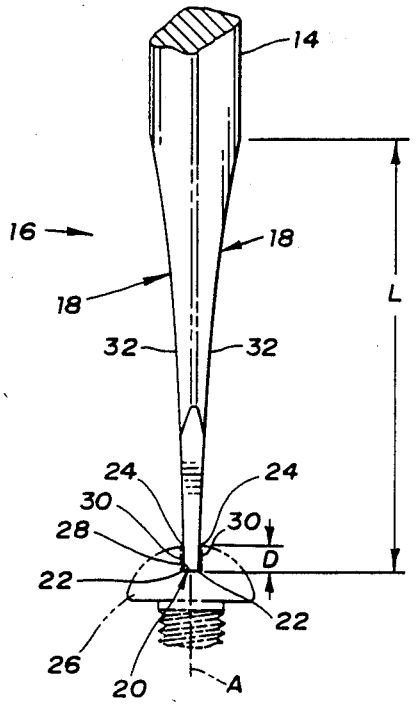
FIG. 3 is an enlarged partial side view of a shank and blade of the screwdriver shown with a screw into whose slot a tip of the blade is inserted to provide rotational driving.

Referring to FIGS. 1 and 2 of the drawings, a screwdriver constructed in accordance with the present invention is generally indicated by 10 and has a central axis A. The screwdriver has a drive end 12 for rotating the screwdriver about the central axis A and also has a shank 14 that extends from the drive end along the central axis A. A blade 16 of the screwdriver projects from the shank 14 along the central axis A for a length L and, as shown in FIGS. 2 and 3, has oppositely facing blade surfaces 18 and a tip 20 that cooperatively define a pair of spaced terminal edges 22 providing a width dimension W as shown in FIG. 1. The length L is in the range of about 3 to 9 W. Each blade surface has an engagement location 24 spaced from the adjacent terminal edge 22 by a depth dimension D that is in the range of about 0.2 to 0.5 W. The blade 16 also includes side surfaces 25 that connect the oppositely facing blade surfaces 18 and converge their entire extents toward the tip 20 as best shown in FIG. 1. and As shown in FIG. 5, a plane through the engagement location 24 of each blade surface 18 and the adjacent terminal edge 22 defines an angle B with the central axis A in the range of about 0.5 to 3.3°The blade surfaces 18 thus converge toward the tip 22 over the entire extents thereof along the entire length L.

The construction of the screwdriver blade 16 described above enhances the ability of the tip 20 to provide rotational driving of a screw 26 with the blade tip 20 inserted into the screw slot 28. More specifically, the blade tip construction maintains contact with the screw head slot 28 with less axial pressure than is required with conventional screwdrivers. Furthermore, when the screwdriver is used as a pry or chisel, the blade construction and specifically the tip thickness thereof provides the required strength to withstand such misuse.

As shown in FIGS. 1 and 2, the drive end 12 is disclosed as being embodied by a handle 29 that is manually grasped to rotate the screwdriver about the central axis A.

Figure 4:
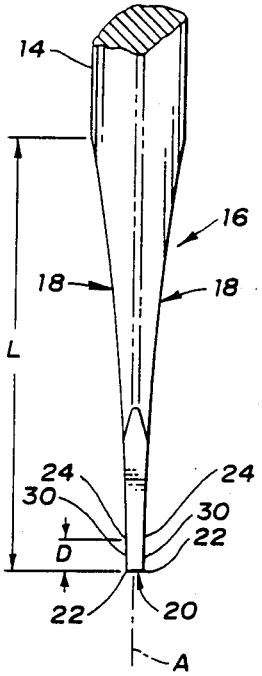
FIG. 4 is a partial view of the screwdriver shank and blade.
Figure 5:
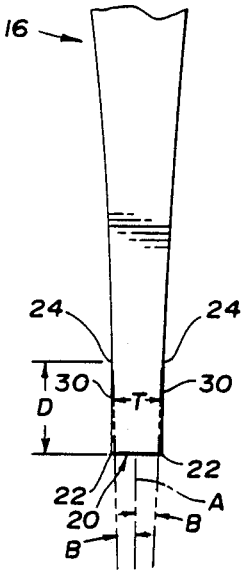
FIG. 5 is a partial view of the screwdriver blade and tip shown in FIG. 4 but on a further enlarged scale to illustrate the blade construction.

In the embodiment of the screwdriver illustrated in FIGS. 3 through 5, each blade surface 18 has a continuously curved shape extending between the shank 14 and tip 20. More specifically, the curved blade surface preferably have a curvature with a radius in the range of about 20 to 120 W.

Figure 6:
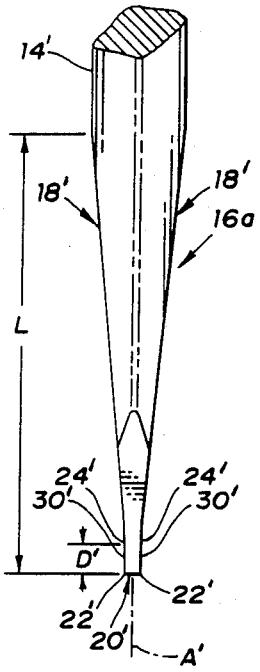
FIG. 6 is a view similar to FIG. 4 of another embodiment of the screwdriver shank and blade.
Figure 8:
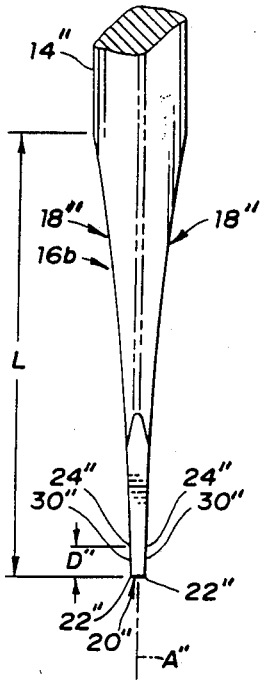
FIG. 8 is a partial view similar to FIGS. 4 and 6 of a further embodiment of the screwdriver shank and blade.
Figure 7:
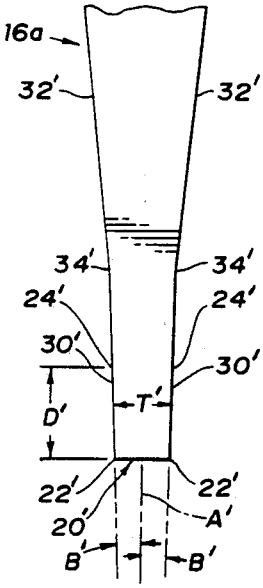
FIG. 7 is a further enlarged partial view of the FIG. 6 embodiment illustrating planar tip surface portions and planar connecting surface portions of the blade.
Figure 9:
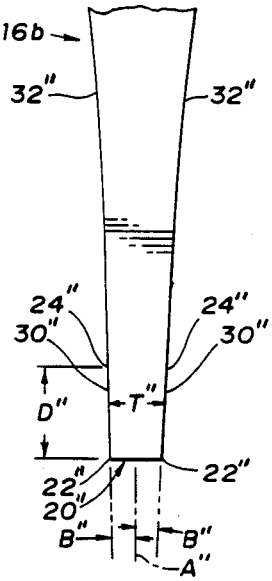
FIG. 9 is a further enlarged view of the FIG. 8 embodiment illustrating the planar tip surface portions and curve connecting surface portions of the blade shown in FIG. 8.

In each of two further embodiments respectively illustrated by the screwdriver blade **16*a* of FIGS. 6 and 7 here like structure is indicated by primed reference numerals and letters and the screwdriver blade 16*b* of FIGS. 8 and 9, where like structure is indicated by double-primed reference numerals and letters the, blade surfaces 18', 18'' have planar tip surface portions 30', 30'' that extend from the terminal edges 22', 22'' for a greater distance than the depth, dimension D', D'' at which the engagement locations 24', 24'' are positioned. More specifically as illustrated, these tip surface portions extend approximately twice the length of the dimension D', D''. Both embodiments of the blades 16*a* and 16*b* have connecting surface portions 32', 32'' that, extend from the tip surface portions to the shank 14', 14''**.

In the embodiment of FIGS. 6 and 7, the connecting surface portions 32' have planar shapes extending between the tip surface portions 30' and the shank 14'. The embodiment **16*a* of the blade also preferably has its blade surfaces 18' provided with curved surface portions 34' that connect the planar tip surface portions 30' and the planar connecting surface portions 32'**.

In the embodiment of the screwdriver blade **16*b* illustrated in FIGS. 8 and 9, the connecting surface portions 32' have curved shapes extending between the planar tip surface portions 30'' and the shank 14''**.

With each of the embodiments of the screwdriver as described above, best results can be achieved with specific parameters of the blade construction. These parameters include having the depth dimension D, D', D'' about $\frac{1}{3}$ of the width dimension W, W', W'' as well as having each angle B, B', B'' about 2 . Furthermore, the terminal edges 22, 22', 22'' of the blade are most preferably spaced from each other by a dimension T, T', T'' and the depth dimension D, D', D'' is in the range of about 0.3 to 2.5 T, T', T'' and most preferably about 1.2 T, T', T''. Also, blade length L, L', L'' is most preferably about 6 W, W', W''.

While the best modes for carrying out the invention have been described in detail, those familiar with the art to which this invention relates will recognize alternative designs and embodiments for practicing the invention as defined by the following claims.

What is claimed is:

1. A screwdriver having a central axis A, the screwdriver comprising:

a drive end for rotating the screwdriver about the central axis A; and a shank that extends from the drive and along the central axis A; and a blade projecting from the shank along the central axis A with a length L, the blade having oppositely facing blade surfaces that extend the entire length of the blade and the blade also having a tip that cooperates with the oppositely facing blade surfaces to define a pair of spaced terminal edges providing a width dimension W, the length L being in the range of 3 to 9 W and the blade surfaces converging over the entire extents thereof toward the tip along the entire distance of length L, each blade surface having an engagement location spaced from the adjacent terminal edge by a depth dimension D that is in the range of 0.2 to 0.5 W, a plane through the engagement location of each blade surface and the adjacent terminal edge defining an angle B with the central axis A in the range of 0.5 to 3.3°, and the blade also having side surfaces that connect the oppositely facing blade surfaces and converge their entire extends toward the tip.

2. A screwdriver as in claim 1 wherein the drive end comprises a handle that is manually grasped to rotate the screwdriver about the central axis A.

3. A screwdriver as in claim 1 wherein each blade surface has a continuously curved shape extending between the shank and the tip.

4. A screwdriver as in claim 3 wherein the curved blade surfaces have a curvature with a radius in the range of about 20 to 120 W.

5. A screwdriver as in claim 1 wherein the blade surfaces have planar tip surfaces portions that extend from the terminal edges for a greater distance than the depth dimension D at which the engagement locations are positioned, and the blade surfaces having connecting surface portions that extend from the tip surface portions to the shank.

6. A screwdriver as in claim 5 wherein the connecting surface portions have planar shapes extending between the tip surface portions and the shank.

7. A screwdriver as in claim 6 further comprising curved surface portions that connect the planar tip surface portions and the planar connecting surface portions.

8. A screwdriver as in claim 5 wherein the connecting surface portions have curved shapes extending between the planar tip surface portions and the shank.

9. A screwdriver as in claim 1 wherein the depth dimension D is about $\frac{1}{3}$ of the width dimension W.

10. A screwdriver as in claim 1 wherein each angle B is about 2°.

11. A screwdriver as in claim 1 wherein the terminal edges are spaced from each other by a thickness dimension T, and the depth dimension D being in the range of about 0.3 to 2.5 T.

12. A screwdriver as in claim 11 wherein depth dimension D is about 1.2 T.

13. A screwdriver as in claim 1 wherein the length L is about 6 W.

14. A screwdriver as in claim 1 wherein: the depth dimension D is about $\frac{1}{3}$ of the width dimension W; each angle B is about 2°; the terminal edges are spaced from each other by a thickness dimension T with the depth dimension D being in the range of about 0.3 to 2.5 T; and the length L being about 6 W.

* * * * *

UNITED STATES PATENT AND TRADEMARK OFFICE

CERTIFICATE OF CORRECTION

PATENT NO. : 4,977,800

DATED : December 18, 1990

INVENTOR(S) : David S. Colvin

It is certified that error appears in the above-identified patent and that said Letters Patent is hereby corrected as shown below:

Title page, item [56]

References Cited - "DeAlt, Jr." should be --Williams, Jr.--

Column 1, Line 65
"include" should be --incline--

Column 3, line 28 "2" should be --2°--

Column 4, Line 32 after "FIG. 1" and before "As" delete --and--.

Column 4, Line 36
after "3.3°" and before "The" insert a --.--.

Column 4, Line 62 "here" should be

--where--.

UNITED STATES PATENT AND TRADEMARK OFFICE

CERTIFICATE OF CORRECTION

PATENT NO. : 4,977,800

DATED : December 18, 1990

INVENTOR(S) : David S. Colvin

It is certified that error appears in the above-identified patent and that said Letters Patent is hereby corrected as shown below:

Column 4, Line 65
after "letters" insert a --,-- and after "the" delete the --,--.

Column 5, Line 17 "32°" should be --32"--

Column 6, Line 8, Claim 1 "extends"

should be --extents--.

Signed and Sealed this

First Day of March, 1994

Bruce Lehman

*Attest:*

BRUCE LEHMAN

*Attesting Officer*

*Commissioner of Patents and Trademarks*